US011391055B2

(12) United States Patent
Parker

(10) Patent No.: US 11,391,055 B2
(45) Date of Patent: Jul. 19, 2022

(54) UMBRELLA POLE ADAPTER FOR BOAT TABLE LEG MOUNTS

(71) Applicant: Ronald Gerard Parker, Punta Gorda, FL (US)

(72) Inventor: Ronald Gerard Parker, Punta Gorda, FL (US)

( * ) Notice: Subject to any disclaimer, the term of this patent is extended or adjusted under 35 U.S.C. 154(b) by 128 days.

(21) Appl. No.: 17/039,504

(22) Filed: Sep. 30, 2020

(65) Prior Publication Data

US 2022/0098891 A1 Mar. 31, 2022

(51) Int. Cl.
*E04H 12/22* (2006.01)
*A47B 37/04* (2006.01)
*A45B 23/00* (2006.01)

(52) U.S. Cl.
CPC ..... *E04H 12/22* (2013.01); *A47B 37/04* (2013.01); *A45B 2023/0012* (2013.01)

(58) Field of Classification Search
CPC .. E04H 12/22; A47B 37/04; A45B 2023/0012
USPC ..... 248/224.7, 85, 87, 156; 211/62
See application file for complete search history.

(56) References Cited

U.S. PATENT DOCUMENTS 2,343,585 A * 3/1944 Schott ..... F16C 33/22 384/97
5,318,372 A * 6/1994 Besthorne ..... B43K 23/00 401/20
5,394,822 A * 3/1995 Worland ..... B63B 34/565 114/361
5,921,657 A * 7/1999 Case ..... F21L 15/14 362/103
6,039,061 A * 3/2000 Utley ..... A45B 1/00 114/361
8,490,255 B1 * 7/2013 Alhanati ..... A45C 13/30 248/524
2006/0143803 A1 * 7/2006 Westervelt ..... A41D 27/20 2/247
2006/0156600 A1 * 7/2006 Barker ..... G09F 17/00 40/591
2009/0261585 A1 * 10/2009 Ward ..... E03C 1/1222 285/418
2011/0232038 A1 * 9/2011 Miller ..... A63B 60/14 16/421
2017/0225752 A1 * 8/2017 O'Neal ..... B63B 29/06
2019/0002184 A1 * 1/2019 Pimentel ..... B65D 81/3879

* cited by examiner

*Primary Examiner* — Muhammad Ijaz

(57) ABSTRACT

An umbrella pole adapter to convert boat dining table leg mounts into temporary umbrella stands is presented. The umbrella adapter is a tubular oval design shape member consisting of an upper end and a bottom end with a center opening running thru the length. The unique tubular oval design shape and the rubber material for the center opening, enables the umbrella anchor pole to be inserted and secured inside the adaptor without the need for any other parts. The same unique tubular oval design shape and rubber material for the exterior wall, enables the adapter to be inserted and secured inside the boat hollow dining table leg mount, without the need for any other parts.

1 Claim, 3 Drawing Sheets

UMBRELLA POLE ADAPTER FOR BOAT TABLE LEG MOUNTS

CROSS-REFERENCE TO RELATED APPLICATIONS

This application claims the benefit of U.S. Provisional Application No. 63/006,809 filed on Apr. 8, 2020. The above identified patent application is herein incorporated by reference in its entirety to provide continuity of disclosure.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING" A TABLE, OR A COMPUTER PROGRAM LISTING APPENDIX SUBMITTED ON COMPACT DISC AND AN INCORPORATION BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

The present invention relates to an umbrella pole adapter. More particularly, it relates to an umbrella pole adapter used to easily convert boat dining table leg mounts into temporary umbrella stands.

As a long time boater our experience and those of many others is; there is not enough shaded areas on recreational boats. The Bimini or hard tops, that are provided by the manufacturer for recreational boats, only provide limited shade for the center of the boat, mostly designed to protect the boat center console and limited center sitting area.

If you want to sit in the forward "Bow" area or in the rear "Stern" area of the boat, you are sitting in the hot unprotected sun. Some of the best views and cross breezes are in the forward Bow or rear Stern area.

The majority of boat manufacturers have dining table leg mounts both in the Bow and Stern area.

Having the ability to easily convert the dining table leg mount into a temporary umbrella stand provides the much needed additional shade, so you can comfortably enjoy all the sitting or lounging areas of recreational boating while shading yourself from the sun.

Therefore there exists a need in the known art for a removable device that is capable of securing an umbrella inside a boat dining table leg mount to provide additional shade on boats.

BRIEF SUMMARY OF INVENTION

The present invention provides a means to easily convert, with a single removable device, a boat dining table leg mount, located in the front Bow and rear Stern areas, into a temporary umbrella stand. This will provide additional shade and comfort to sitting and lounging areas in the front Bow and rear Stern areas of the boat that receive full unprotected sun.

BRIEF DESCRIPTION OF THE SEVERAL VIEWS OF THE DRAWING

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
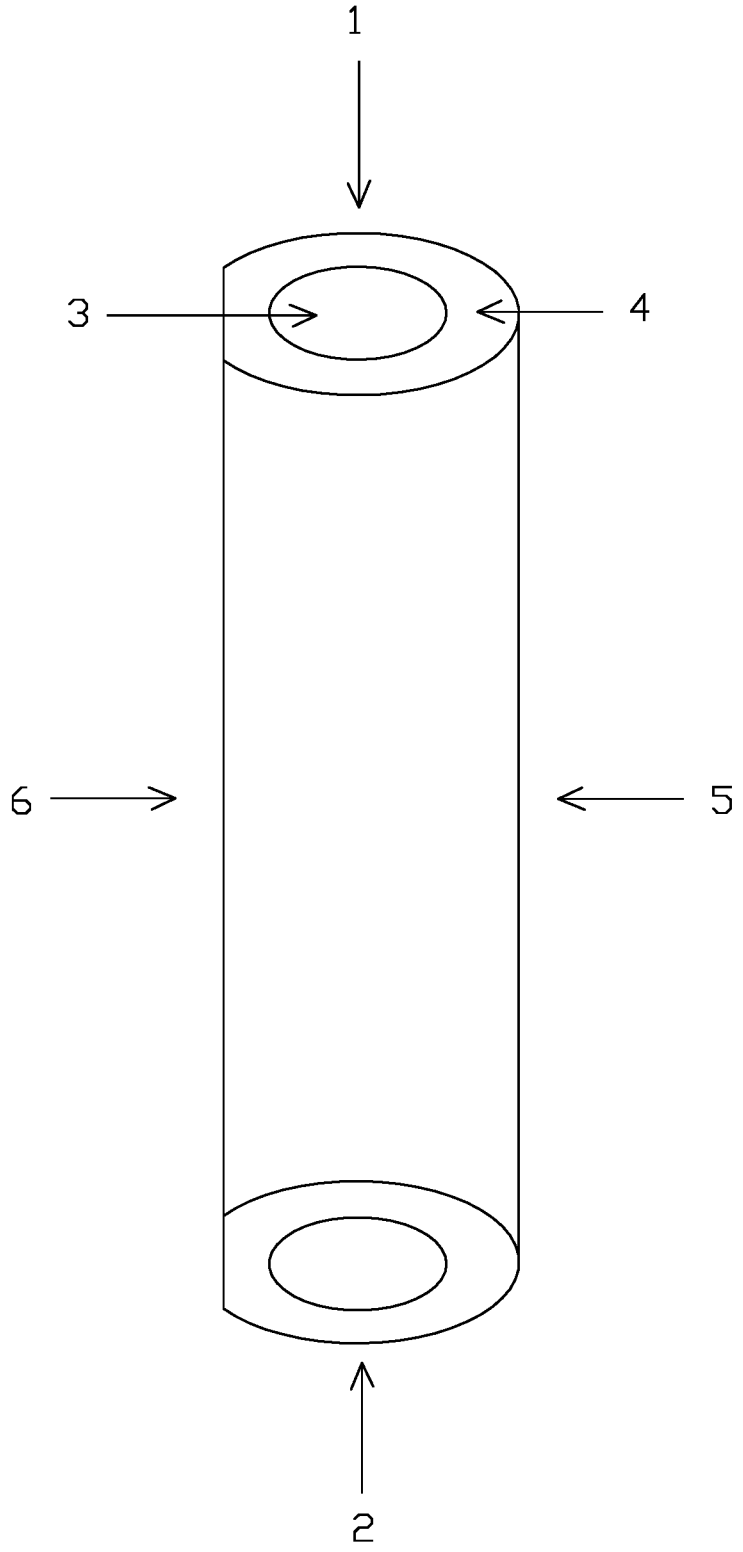
FIG. 1 shows a perspective view of an embodiment of the umbrella adapter.

Reference will now be made in detail to the present preferred embodiment, examples of which are illustrated in the accompany drawings. Like reference numerals are used throughout the drawings to depict like or similar elements of the umbrella pole adapter. The figures are intended for representative purposes only and should not be considered to be limiting in any respect.

Referring to FIG. 1 is a perspective view of an embodiment of the umbrella adapter. The adapter is single device made of 100% Neoprene Rubber and no other parts, comprising of a unitary tubular oval design shape or substantially cylindrical member having an exterior surface and an interior surface, with an open upper end 1 and an open bottom end 2. The upper and lower ends (1, 2) are flat. The tubular oval shape center opening 3 runs thru the entire length of the adapter. The rubber exterior wall 4 thickness surrounds the entire length of the center opening 3. The flattened exterior side wall or portion 6 creates the tubular oval shape design that runs the entire length of the adapter.

In order to achieve the necessary grip for the umbrella pole, the manufacturing of the adaptor design involves not rotating the tubular rubber material while being shaped on the production tool. This creates a flat side wall 6 which is a critical design step in the manufacturing, to allow the adapter to take on a tubular oval shape for both the center opening 3 and the exterior walls 5 and 6.

Figure 2:
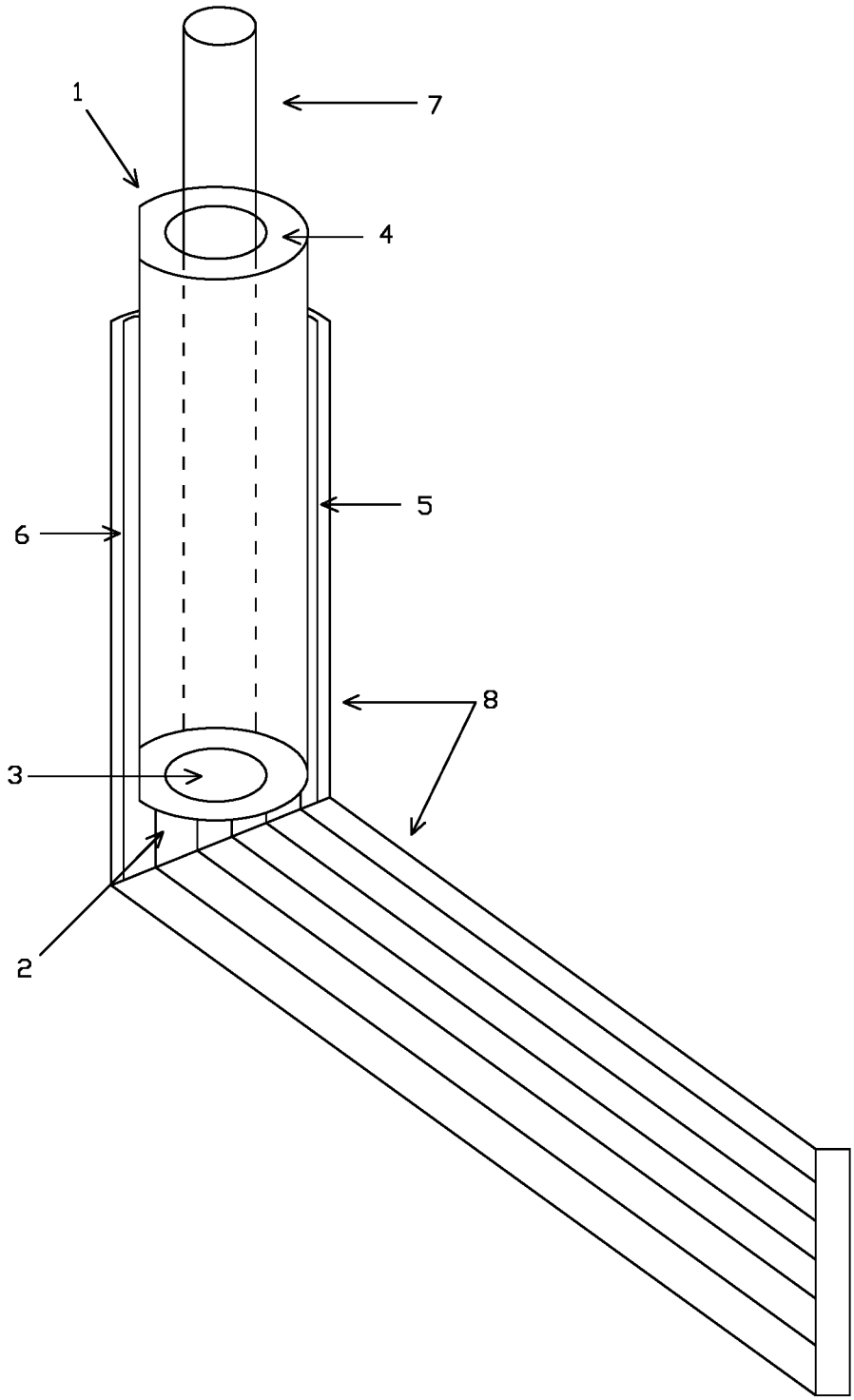
FIG. 2 shows a close-up view of the umbrella adapter inserted into the hollow boat dining table leg mount with an umbrella pole inserted into the center opening of the umbrella adapter.

The tubular oval shape design along with the quality grade Neoprene rubber material, allows the umbrella anchor pole to fit secure inside the center opening 3 and for the adapter exterior walls 5 and 6 to fit secure inside the cylindrical hollow dining table leg mount shown in FIG. 2

Referring now to FIG. 2, there is shown a perspective view of an embodiment close-up of the umbrella pole adapter upper end 1 and bottom end 2 inserted into a boat dining table leg mount 8 and the umbrella anchor pole 7 inserted thru the entire length of the center opening 3 of the adapter.

Both the umbrella anchor pole 7 and the adaptor upper end 1 and bottom end 2 are removal by hand when ready to convert back to a boat dining table leg mount.

Figure 3:
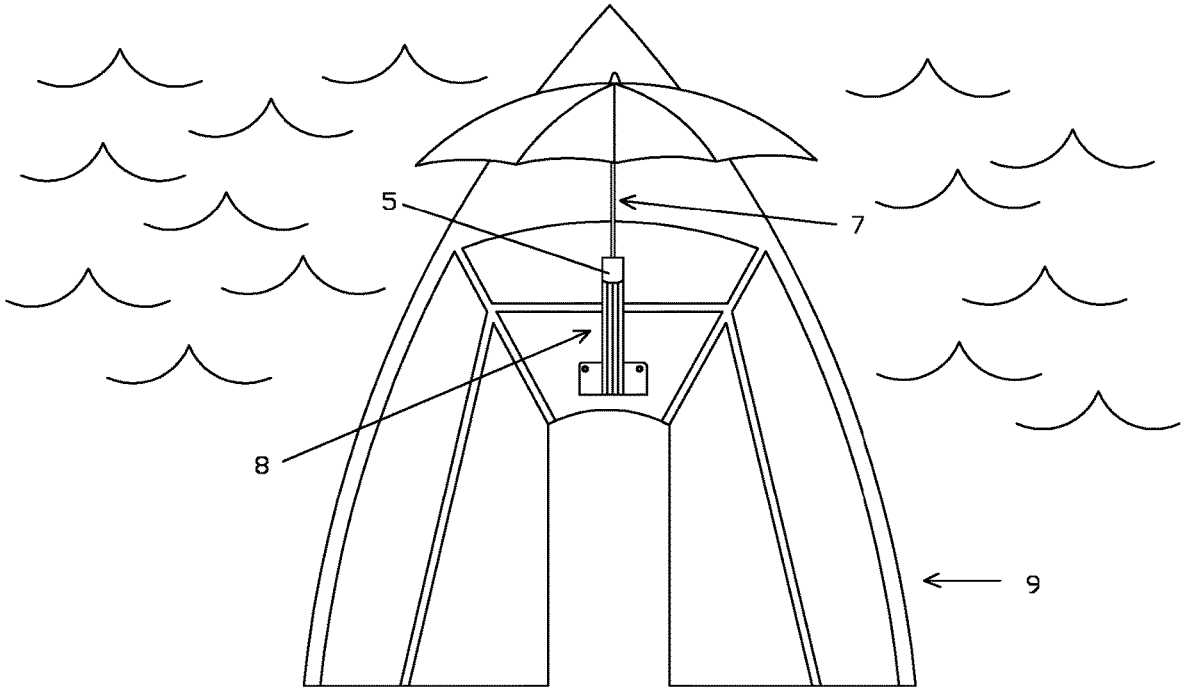
FIG. 3 shows a perspective view of an embodiment of the umbrella adapter in use on the Bow of a boat.

Referring now to FIG. 3, there is shown a perspective view of an embodiment of the umbrella pole adapter 5 in use on a boat Bow 9. In use, the umbrella pole adapter 5 is inserted into the hollow dining table leg mount 8. The umbrella anchor pole 7 is then inserted into the adapter securing the umbrella pole in place. Once the umbrella anchor pole is secured, you can attach and open the umbrella.

It is therefore submitted that the instant invention has been shown and described in various embodiments. It is recognized, however, that departures may be made within the scope of the invention and that obvious modifications and other embodiments i.e. use in fishing rod holders on boats, will occur to a person skilled in the art. With respect to the above description then, it is to be realized that the optimum dimensional relationships for the part of the invention, to include variations in sizes, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella pole adapter for converting boat dining table leg mounts into temporary umbrella stands the umbrella pole adapter consisting of:

a unitary substantially cylindrical member made of neoprene rubber having an interior surface and an exterior surface wherein said exterior surface defining a flat longitudinal portion on one side of said exterior surface said longitudinal flat portion extends from an upper end to a bottom end of the umbrella pole adapter such that ends of said longitudinal flat portion conform to ends of said exterior surface;

wherein said longitudinal flat portion is configured to apply a pressure to the interior surface and to the exterior surface, said upper end and said bottom end having a through opening, wherein said upper end and said bottom end are substantially flat, wherein said umbrella pole adapter is configured to secure an umbrella pole to be inserted and secured into the through opening without use of fasteners and tools, wherein at least half of said umbrella pole adapter and said longitudinal flat portion are configured to be inserted and secured into a hollow cylindrical boat dining table leg mount without use of the fasteners and tools.

* * * * *